US008375661B1

(12) United States Patent
diGirolamo et al.

(10) Patent No.: US 8,375,661 B1
(45) Date of Patent: Feb. 19, 2013

(54) COMPOSITE METAL DECK AND CONCRETE FLOOR SYSTEM

(75) Inventors: Edward R. diGirolamo, Raleigh, NC (US); John C. Herrmann, Raleigh, NC (US)

(73) Assignee: The Steel Netork, Inc., Durham, NC (US)

( * ) Notice: Subject to any disclaimer, the term of this patent is extended or adjusted under 35 U.S.C. 154(b) by 0 days.

(21) Appl. No.: 13/087,890

(22) Filed: Apr. 15, 2011

(51) Int. Cl.
*E04C 5/08* (2006.01)
*E04C 2/52* (2006.01)

(52) U.S. Cl. ..... 52/223.13; 52/223.6; 52/220.4; 52/223.11

(58) Field of Classification Search ..... 52/223.13, 52/220.4, 223.6, 223.11
See application file for complete search history.

(56) References Cited

U.S. PATENT DOCUMENTS

| | | | | |
|---|---|---|---|---|
| 5,491,931 | A * | 2/1996 | Haddock | 52/25 |
| 5,715,640 | A * | 2/1998 | Haddock | 52/545 |
| 5,983,588 | A * | 11/1999 | Haddock | 52/545 |
| 6,164,033 | A * | 12/2000 | Haddock | 52/545 |
| 7,013,612 | B2 * | 3/2006 | Haddock | 52/545 |
| 7,021,023 | B2 * | 4/2006 | Rood, Jr. | 52/748.1 |
| 7,213,373 | B2 * | 5/2007 | Hockman | 52/24 |
| 7,513,080 | B1 * | 4/2009 | Showalter | 52/24 |
| 7,571,576 | B2 * | 8/2009 | Pruitt | 52/250 |
| 7,703,256 | B2 * | 4/2010 | Haddock | 52/543 |
| 7,774,989 | B2 * | 8/2010 | Fisher | 52/26 |
| 8,070,119 | B2 * | 12/2011 | Taylor | 248/237 |
| 2004/0055233 | A1 * | 3/2004 | Showalter | 52/223.13 |
| 2008/0053014 | A1 * | 3/2008 | Hovey, Jr. | 52/223.11 |
| 2008/0066409 | A1 * | 3/2008 | Pruitt | 52/414 |

* cited by examiner

*Primary Examiner* — Mark Wendell
(74) *Attorney, Agent, or Firm* — Coats & Bennett, P.L.L.C.

(57) ABSTRACT

A deck pan assembly for receiving and supporting concrete that is utilized as a floor system in a building. The deck pan assembly comprises a plurality of deck pans with each deck pan including a bottom and an upturned edge. The deck pans are disposed in side-by-side relationship and spaced such that the turned up edges of two deck pans lie adjacent each other and form a connecting structure that permits the two deck pans to be connected together. Further the assembly includes an elongated stiffening connector extending along the connecting structure and at least partially covering the turned up edges that form the connecting structure. The elongated stiffening connector includes a pair of spaced apart sides, and the connecting structure, formed by the upturned edges of two deck pans, is inserted between the spaced apart sides such that the spaced apart sides extend downwardly adjacent outer surfaces of the connecting structure. Fasteners are employed to connect the stiffening connector to the connecting structure of the deck pan. The elongated stiffening connector and the deck pans are constructed of sheet metal and wherein the sheet metal that forms the elongated stiffening connector is of a heavier gauge metal than the sheet metal that forms the deck pans.

15 Claims, 6 Drawing Sheets

COMPOSITE METAL DECK AND CONCRETE FLOOR SYSTEM

FIELD OF THE INVENTION

The present invention relates to light metal frame structures and more particularly to a composite metal and concrete deck that forms a part of a floor system.

BACKGROUND OF THE INVENTION

Composite metal and concrete deck floor systems are known. These composite structures include a metal deck and a concrete slab supported on the metal deck. More particularly, one type of composite deck system comprises a concrete slab which is reinforced and supported by a cold formed steel deck. These two basic components work together to provide superior load carrying capability. The metal deck material is of a uniform thickness. In some traditional designs, the cold formed metal deck is shaped such that there is provided a generally horizontal bottom with portions of the deck bent and shaped so as to project upwardly from the bottom. The metal deck material is of a uniform thickness. The horizontal portion of the metal deck serves as a form for the concrete. In addition, the horizontal portion of the metal deck functions as a positive reinforcement for the structural concrete slab. The upstanding portions of the metal deck that project upwardly from the bottom also adds load carrying capacity to the deck assembly.

There are generally three phases to the construction of such a deck. First the metal decking is laid down over supports. Sometimes intermediate and temporary supports may be required. The decking must support itself and also the personnel and equipment needed to install it. As noted above, in some conventional metal decks for flooring, there is provided upstanding structures formed in the metal itself. The tops of these upstanding structures are generally in compression while the horizontal or bottom portions of the deck are in tension. It is well recognized that steel is most efficient when in tension. Next, concrete is poured onto the metal deck. There is no composite action yet, so the metal deck must now support the added weight of the concrete. In the third phase, the concrete hardens and the composite action takes place between the metal decking and the concrete. The top of the concrete slab is in compression which, as is well known, is where concrete is most efficient. As one looks down through the concrete, more tension forces are experienced and the further down in the concrete, the weaker the concrete becomes. The steel portion or the metal deck portion now comes into play and provides additional tensile strength to the assembly.

There are several limitations or disadvantages to such a conventional composite metal-concrete deck floor. First there is a tradeoff in decking metal thickness. A heavier gauge metal is unnecessary in the bottom or horizontal portion of the metal deck but would add load carrying capacity to the assembly in the structural portions of the deck that project upwardly from the horizontal or bottom portions, especially where the steel is in compression. Conversely, a lighter gauge metal would save on material in the horizontal portion of the metal deck. But this would reduce the load capacity where the steel is in compression.

In addition when a load is applied to a composite metal-concrete deck in a horizontal direction, as may be experienced in a progressive collapse condition or extreme loading event, the decking is subject to spreading apart in the horizontal direction. This could result in a failure of the entire floor system. This is due to the poor tensile strength of concrete and the fact that the metal deck typically does not provide reinforcement that resists such loads.

SUMMARY

The present invention relates to a composite metal-concrete floor used in buildings wherein the composite comprises a multi-piece assembly. Specifically the multi-piece assembly comprises a plurality of deck pans and one or more stiffening connectors that connect the deck pans together. The deck pans are constructed of a relatively light gauge metal while the stiffening connector which adds to the load carrying capacity of the composite is made from a relatively heavier gauge metal.

In one particular embodiment, the present invention entails a deck pan assembly having multiple gauge metal components for receiving concrete. The deck pan assembly includes a series of metal deck pans and at least one stiffening connector for connecting two of the deck pans together. The deck pans are formed from sheet metal having a first thickness while the stiffening connector is formed of sheet metal having a second thickness which is greater than the first thickness. Expressed in another way, the sheet metal that forms the deck pans is of a relatively light gauge while the sheet metal that forms the stiffening connector is of a relatively heavy gauge.

Other objects and advantages of the present invention will become apparent and obvious from a study of the following description and the accompanying drawings which are merely illustrative of such invention.

DETAILED DESCRIPTION

Figure 1:
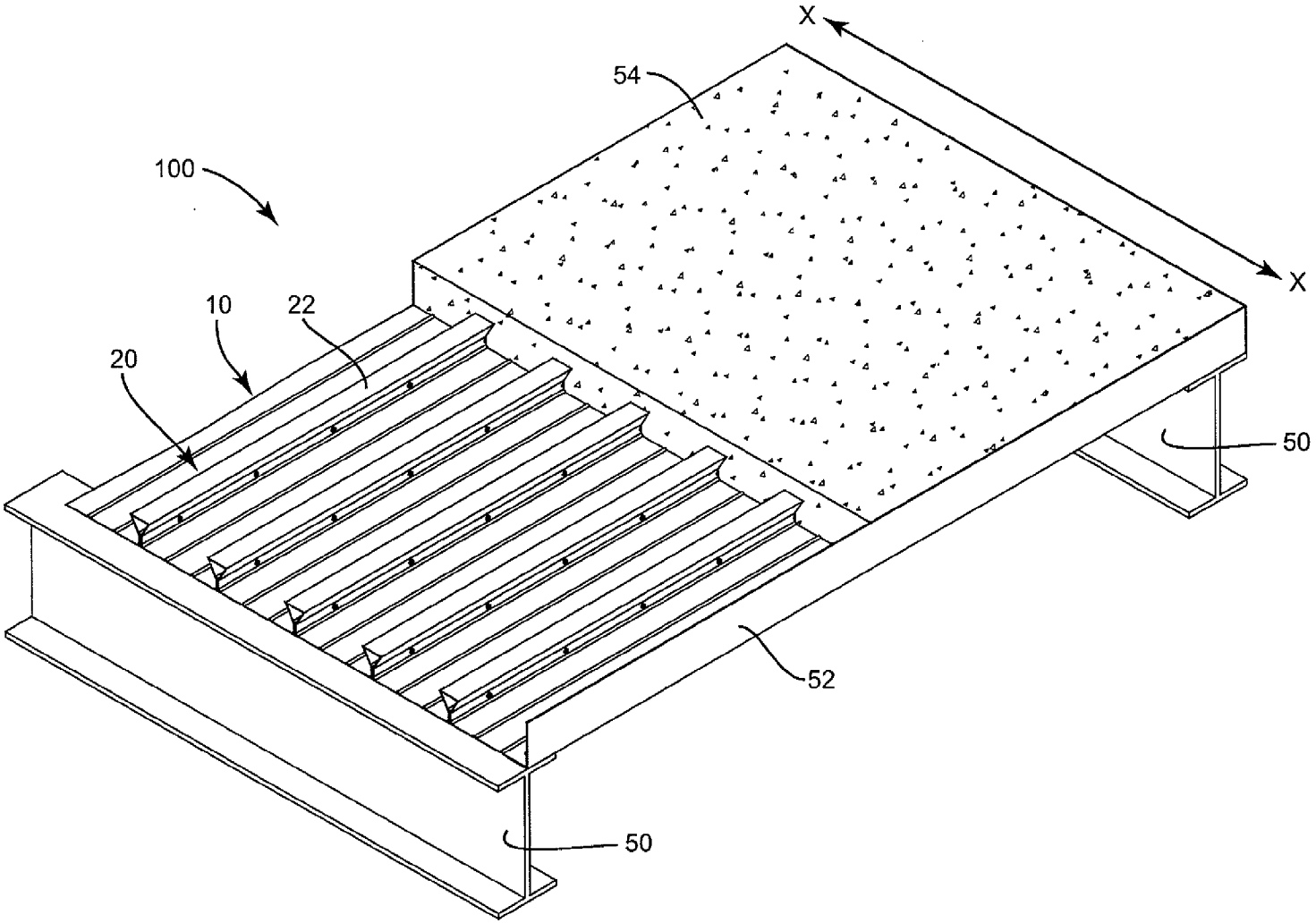
FIG. 1 is a perspective view of the composite deck of the present invention with portions of the concrete broken away to better illustrate the structure of the underlying deck pan assembly.

With further reference to the drawings, a composite floor deck is shown and indicated generally by the numeral 100. Composite floor deck 100 is made up of a combination of sheet metal components and concrete. The sheet metal components comprise a plurality of deck pans with each deck pan indicated generally by the numeral 10. Further the metal components include one or more metal stiffening connectors indicated generally by the numeral 20. Stiffening connector 20 is utilized to connect two deck pans 10 together. As appreciated from the drawings, once the deck pans 10 are connected via the stiffening connectors 20, a metal deck is formed for receiving and supporting concrete 54.

Figure 2:
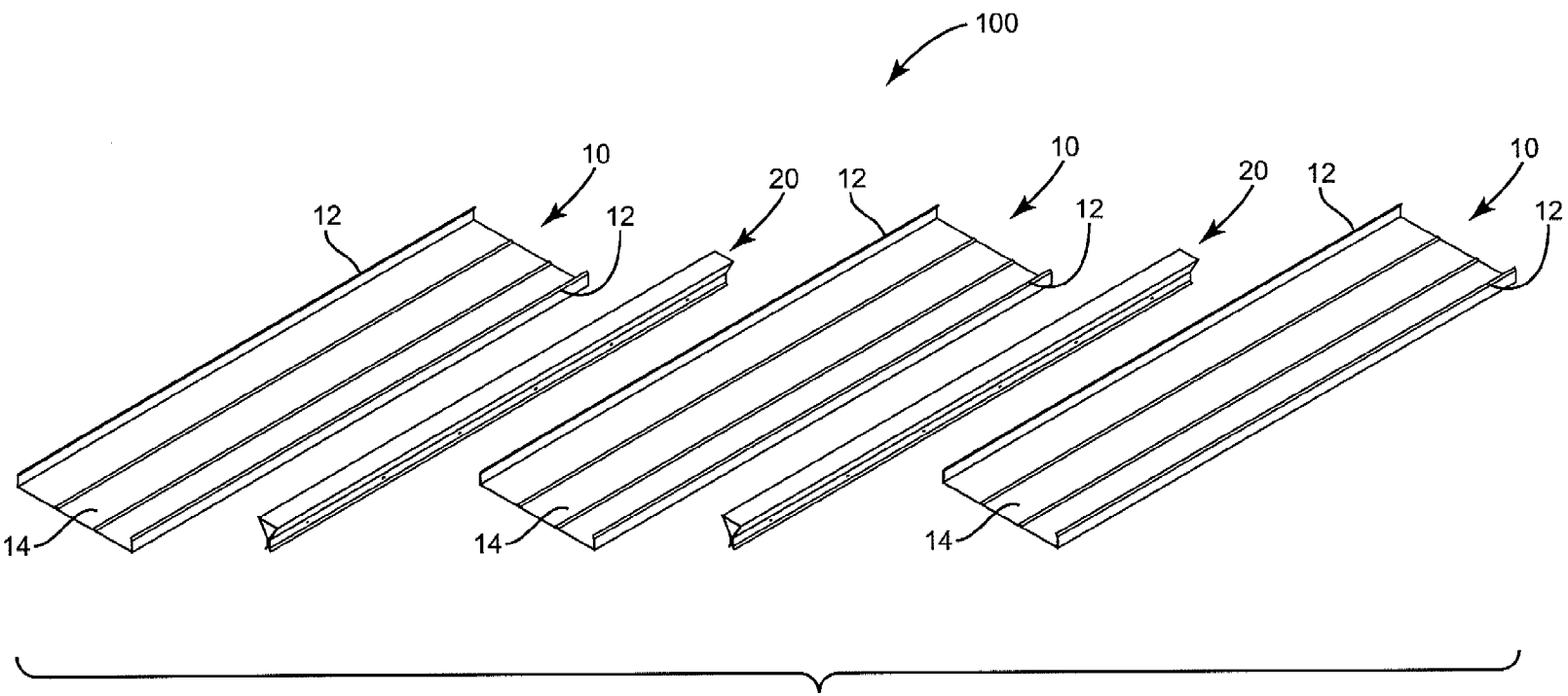
FIG. 2 is a perspective exploded view of the deck pan assembly of the present invention that forms a part of the composite deck shown in FIG. 1.

With reference to FIG. 2, each deck pan 10 includes a bottom or web 14. Formed on opposite sides of the bottom 14 is a pair of flanges or upturned edges 12. Thus it is appreciated that with respect to the deck pan design shown in FIG. 2 that the deck pan assumes a generally channel or U-shape.

Figure 5:
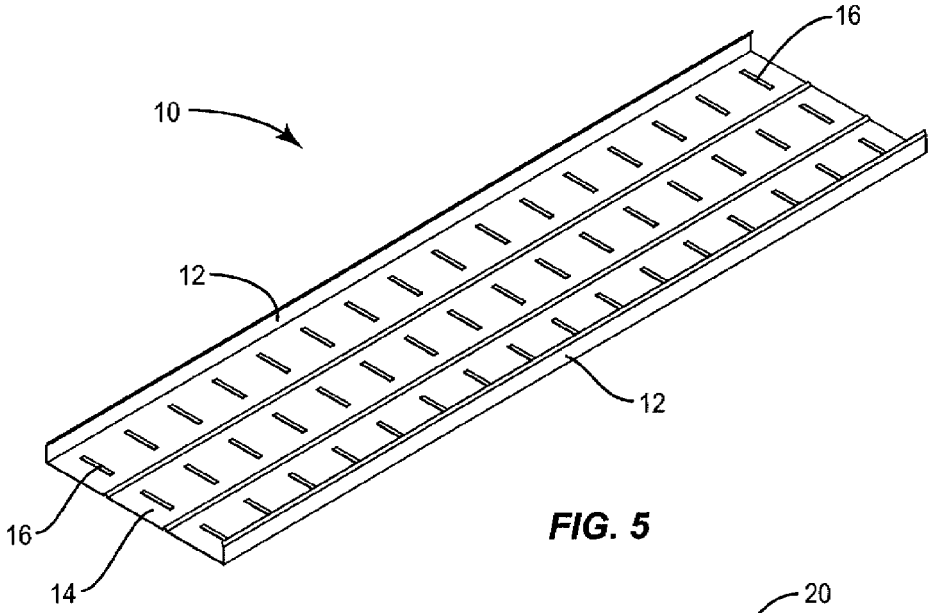
FIG. 5 is a perspective view showing an alternative design for a deck pan.

An alternative design is shown in FIG. 5. This design is essentially the same as the design shown in FIG. 2 with the exception that the deck pan 10 shown in FIG. 5 includes a series of ribs 16 formed in the bottom 14 of the pan. Ribs 16 tend to reinforce the deck pan 10 and impart structural strength to the bottom of the deck pan.

Figure 3:
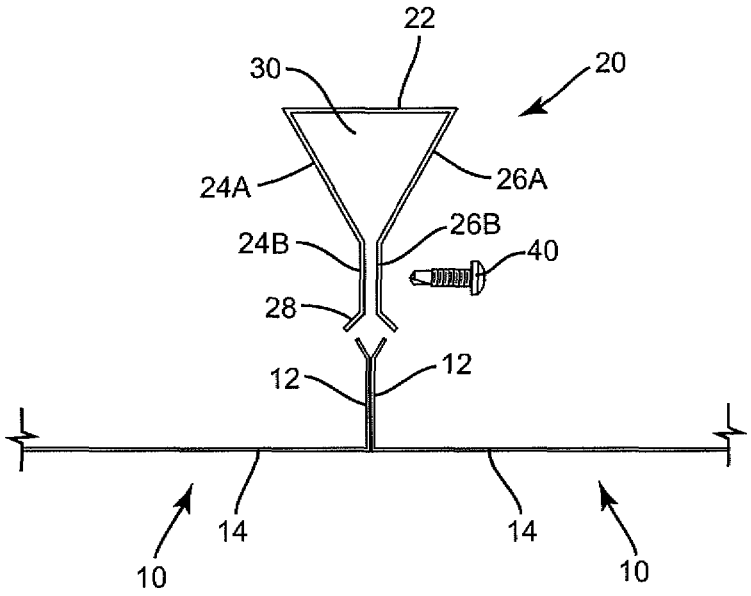
FIG. 3 is a schematic elevational view illustrating how the deck pan assembly is assembled.
Figure 4:
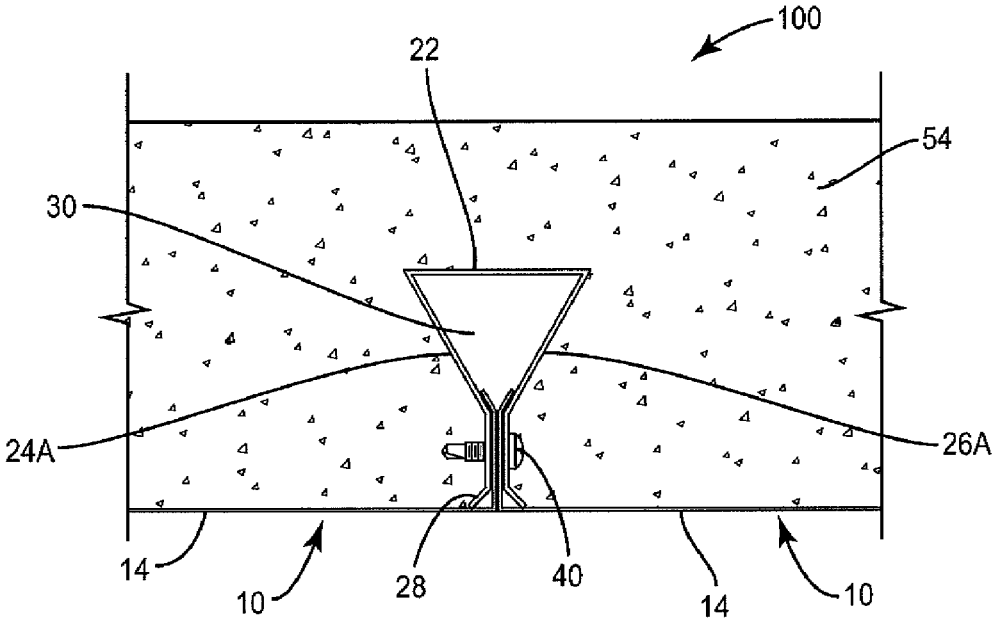
FIG. 4 is a fragmentary side elevational view showing the composite deck and illustrating how the components of the deck pan assembly shown in FIG. 3 are assembled.

As discussed above, the stiffening connector 20 is designed to connect two deck pans together as shown in FIGS. 3 and 4 for example. Each stiffening connector 20 assumes a generally inverted trough shape. As viewed in FIG. 3, the stiffening connector 20 includes a top 22 and a pair of downwardly depending flexible sides. In particular, on one side of the stiffening connector 20 there is provided side portions 24A and 24B while on the other side there is provided side portions 26A and 26B. The upper sides 24A and 26A converge downwardly from the top 22 to a point where the side portions join the lower side portions 24B and 26B. Note that the side portions 24B and 26B are generally spaced apart but extend in parallel relationship. The lower terminal ends of the lower side portions 24B and 26B form a diverging mouth 28. An open area 30 is formed in the upper portion of the stiffening connector 20. Note in FIG. 2 where the open area 30 is generally bounded by the top 22 and the upper side portions 24A and 26A of the stiffening connector 20.

Figure 6:
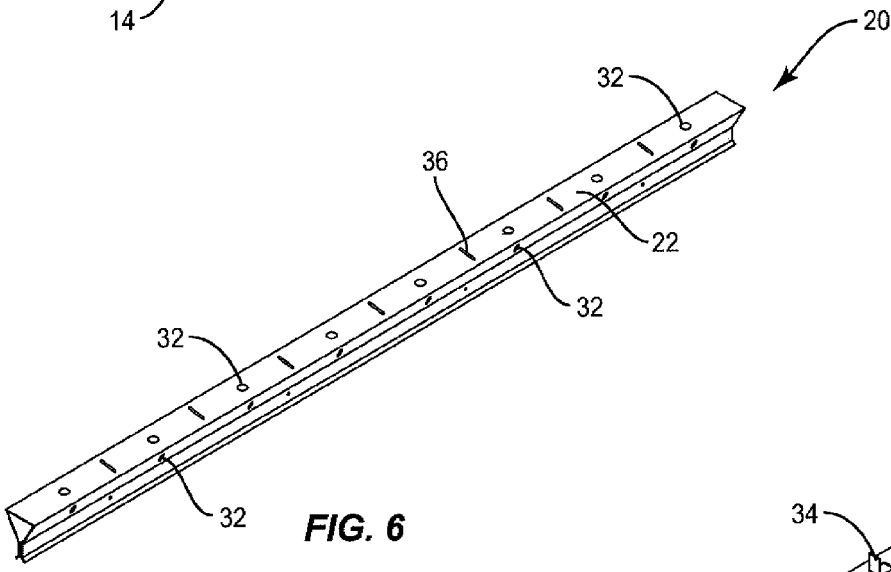
FIG. 6 is a perspective view showing an alternative design for the elongated stiffening connector utilized to connect two deck pans together.
Figure 7:
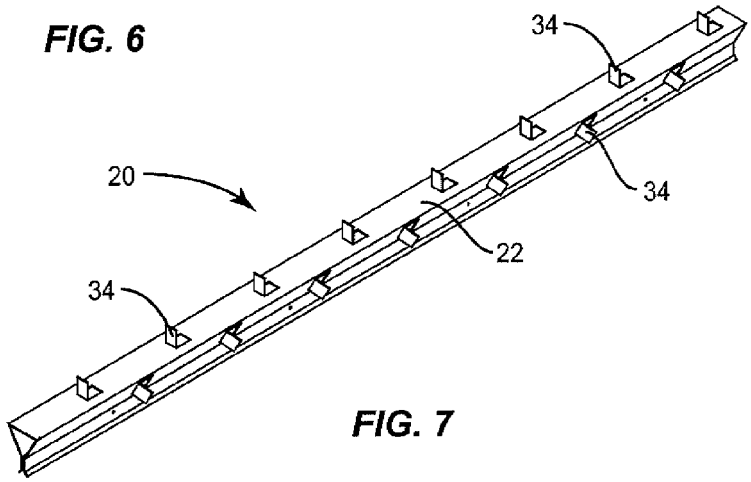
FIG. 7 is another alternative view of the elongated stiffening connector utilized to connect two deck pans together.

FIGS. 6 and 7 illustrate alternative embodiments for the stiffening connector 20. For example, the stiffening connector 20 shown in FIG. 6 is provided with a series of openings 32. Openings 32 are disposed along the length of the stiffening connector 20 and are disposed in spaced apart relationship. Openings 32 are formed in the top 22 as well as the upper side portions 24A and 26A of the stiffening connector 20. Openings 32 permit concrete to enter the open area 30 formed in the stiffening connector 20. In addition a series of ribs 36 are formed in the top 22 of the stiffening connector 20. Ribs 36 are optional but can provide additional reinforcement and structural strength to the stiffening connector 20.

In the FIG. 7 embodiment, the stiffening connector 20 is provided with a series of tabs 34 that extend outwardly from the main body of the stiffening connector. Note that in the embodiment shown in FIG. 7 that the tabs 34 are formed on the top 22 as well as the upper side portions 24A and 26A of the stiffening connector. The tabs can be formed and secured in various ways. In one embodiment the tabs are simply cut from the top 22 and the upper side portions 24A and 26A and bent outwardly such that they project generally normal to the adjacent surface of the stiffening connector 20.

FIG. 3 illustrates how the deck pans are interconnected by the stiffening connector 20. Note that the deck pans 10 are disposed in side-by-side relationship and that a flange or upturned edge 12 from each deck pan 10 is disposed adjacent a flange or upturned edge 12 of an adjacent deck pan. Flanges 12 as shown in FIG. 3 form a connecting structure. That is, the flanges 12 disposed in side-by-side or back-to-back relationship form a connecting structure that the stiffening connector 20 connects to.

In the embodiment illustrated in FIG. 3, the connecting structure formed by the two flanges 12 forms a Y-shaped structure. The upper portions of the flanges 12 are angled outwardly to form angled ears. In the embodiment illustrated herein, the maximum width of the pair of flanges 12, as shown in FIG. 3, is greater than the space between the lower side portions 24B and 26B of the stiffening connector 20.

Continuing to refer to FIG. 3, to connect the stiffening connector 20 to the connecting structure formed by the flanges 12, the upper portion of the flanges 12 is inserted into the mouth 28 of the stiffening connector. Stiffening connector 20 is pushed downwardly around the flanges 12. Since the upper portion of the flanges 12 is wider than the space between side portions 24B and 26B, the sides of the stiffening connector 20 will flex outwardly as the connecting structure of the deck pans 10 is inserted into the stiffening connector. The angled ears of the flanges 12 will move through the space between the side portions 24B and 26B and will snap into place as shown in FIG. 4.

A series of fasteners 40 secure the stiffening connector 20 to the connecting structure of the pans 10. Various types of fasteners such as screws, rivets, or weldment can be used to connect the stiffening connector 20 to the connecting structure. In the embodiment illustrated, there is provided a series of self-tapping bolts 40 that extend transversely through the flanges 12 as well as the lower side portions 24B and 26B of the stiffening connector 20.

Figure 4A:
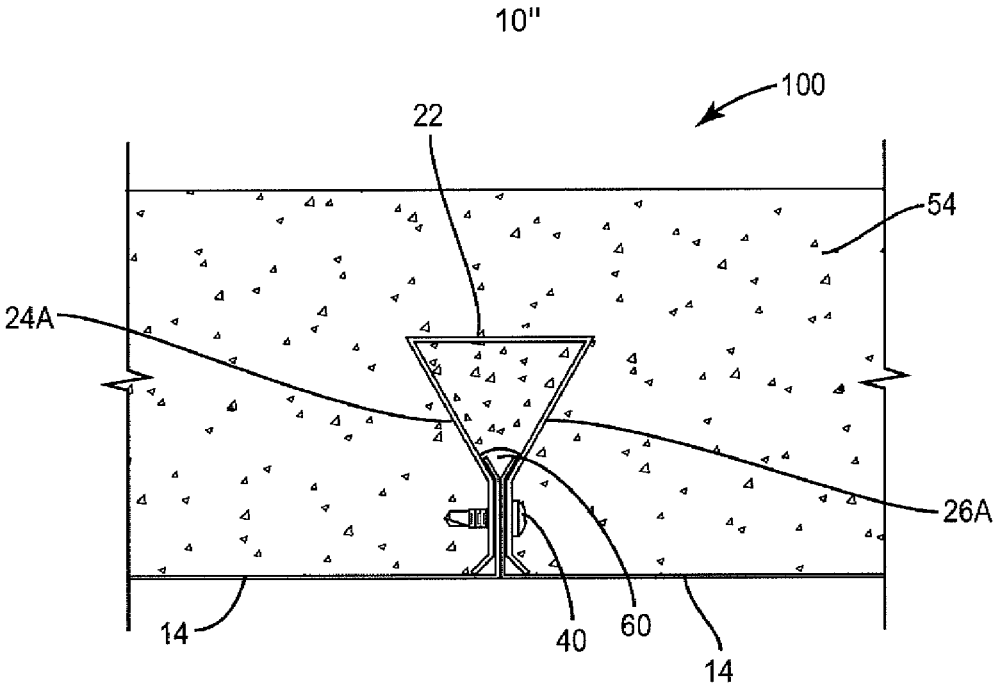
FIG. 4A shows an alternative design for the deck pan assembly.

FIG. 4A shows a slightly different embodiment of the deck pan assembly. In this case, the stiffening connector 20 includes openings 32 (see FIG. 6) that permit concrete to accumulate in the interior area 30 of the stiffening connector. In addition there is provided a seal or strip of sealant 60 that is laid in the angled ears that forms the upper portion of the flanges 12. The seal or sealant 60 prevents wet concrete from seeping into areas between the flanges 12 and is effective in holding concrete within the confines of the upper portion of the stiffening connector 20 as viewed in FIG. 4A.

Figure 2A:
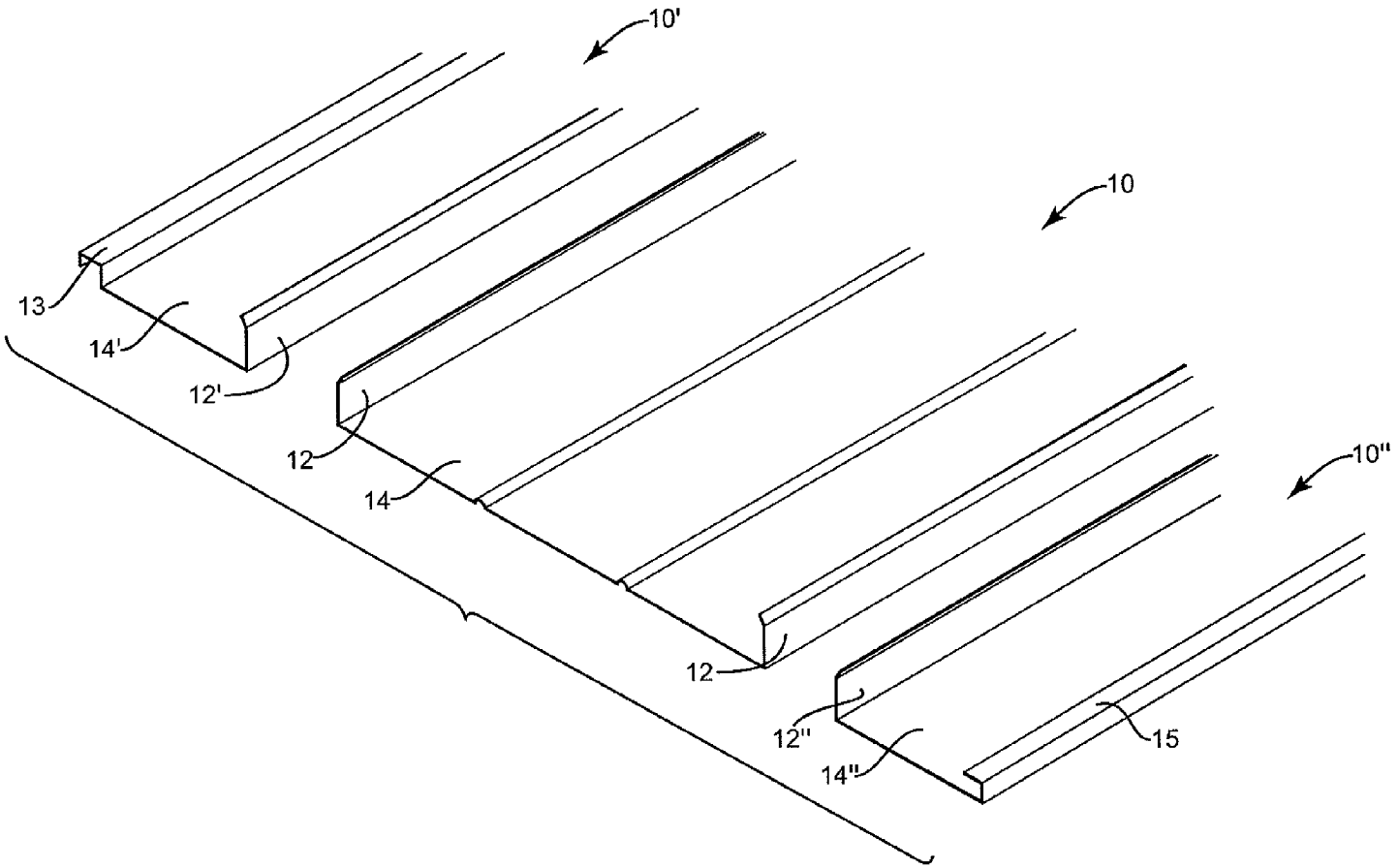
FIG. 2A shows an alternative deck pan assembly.

As noted before, FIGS. 2A and 3A illustrate an alternate design for the pan assembly. This design is substantially similar to the design shown in FIG. 2 and discussed above. However in the case of this alternate design there is provided a left hand deck pan 10' and a right hand deck pan 10". The left hand deck pan 10' includes a bottom or web 14' and along one side or edge a flange or upturned edge 12' similar to the design shown in FIG. 2. However on the other side or edge of the left hand deck pan 10' there is provided an inverted J-shaped flange 13.

Turning to the right hand deck pan 10", it includes a bottom or web 14" and a flange or upturned edge 12". On the side or edge opposite the flange 12" is provided an inverted L-shaped flange 15.

Figure 3A:
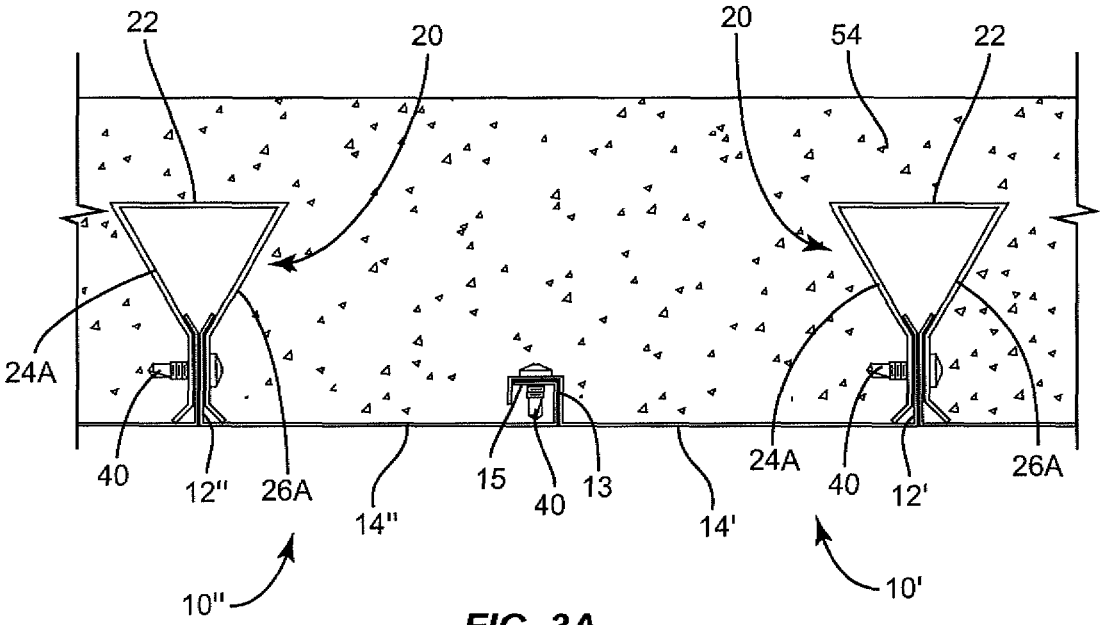
FIG. 3A is a schematic side elevational view showing how the deck pan assembly shown in FIG. 2A is assembled.

As shown in FIG. 3A, the inverted J-shaped flange 13 of the left hand deck pan 10' is designed to mate with the inverted L-shaped flange 15 of the right hand deck pan 10". When they are mated together, these two flanges 13 and 15 can be secured together with fasteners 40.

Flanges 12' and 12" of the left and right hand deck pans 10' and 10" can be joined and secured together in the same manner as discussed above. In the example shown in FIG. 3A, there are four separate deck pans secured together and there is one secured joint formed by the flanges 13 and 15 and two secured joints formed by the flanges 12 of respective deck pans and the elongated stiffening connectors 20.

The deck pan assembly is constructed of sheet metal components wherein the gauge or thickness of the sheet metal components varies. In this design, the deck pans 10, 10' and 10" are constructed of a relatively light gauge sheet metal, for example 20 gauge sheet metal. The stiffening connectors 20 on the other hand are constructed of a relatively heavy gauge sheet metal, a sheet metal having a thickness greater than the thickness of the sheet metal employed for the deck pans. The increased thickness for the stiffening connector 20 increases the strength of the deck assembly during installation and during the wet concrete phase of construction. This is due to the increased metal thickness in the compression region of the composite deck 100. This increased strength will reduce the amount of temporary mid-span supports required, which are costly to erect and disassemble. After the concrete sets, the thicker material in the stiffening connectors 20 serves to further enhance the deck strength.

In addition, the strength provided by the elongated stiffening connectors 20 tends to prevent the deck pan assembly from spreading outwardly in the X direction as viewed in FIG. 1. If a load in the X direction is experienced during a progressive collapse or extreme loading event, the deck flutes of a conventional design will tend to separate since they are in tension, and there is nothing to prevent their movement. The concrete that is in tension during this extreme condition provides little support. However, in the present case, the elongated stiffening connectors 20 connect the respective panels together and because of the design of the elongated stiffeners and the relatively heavy gauge sheet metal used, the concrete is prevented from failing in tension.

FIG. 1 illustrates the composite floor deck 100 that is formed by the deck pan assembly and concrete 54. Note that the deck pan assembly spans and is supported by a pair of support beams 50. That is the deck pan assembly comprised of a series of deck pans 10 which are connected together by a series of stiffening connectors 20, extend between the support beams 50. A pour-stop angle 52 is provided to retain the wet concrete during a pour.

There are numerous advantages to the composite deck described above. First it is a cost effective approach to a composite floor deck design. At the same time this approach optimizes the strength of the deck by selectively placing heavy gauge metal in locations where needed and not employing heavy gauge metal in places where it is not needed.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A deck pan assembly for receiving and supporting concrete, comprising:

a. plurality of deck pans;

b. each deck pan including a bottom and an upturned edge;

c. the deck pans disposed in side-by-side relationship and spaced such that the upturned edges of the two deck pans lie adjacent to each other and form an elongated connecting structure that permits the two deck pans to be connected together;

d. at least one elongated stiffening connector extending substantially along the entire length of the connecting structure and at least partially covering the upturned edges that form the connecting structure;

e. the elongated stiffening connector including a pair of spaced apart sides and wherein the connecting structure is inserted between the spaced apart sides such that the spaced apart sides extend downwardly adjacent outer surfaces of the connecting structure;

f. a plurality of fasteners for connecting the elongated stiffening connector to the connecting structure of the deck pans, each fastener extending transversely through the upturned edges that form the connecting structure and through the spaced apart sides that form a part of the elongated stiffening connector; and g. wherein the elongated stiffening connector and the deck pans are constructed of sheet metal and wherein the sheet metal that forms the elongated stiffening connector is of a heavier gauge metal than the sheet metal that forms the deck pans.

2. The deck pan assembly of claim 1 wherein the deck pan assembly includes at least three deck pans disposed in side-by-side relationship and at least two elongated stiffening connectors; and wherein each elongated stiffening connector is connected to a respective connecting structure formed by the two upturned edges of two deck pans by series of fasteners that extend transversely through the connecting structure and through the spaced apart sides that form a part of each elongated stiffening connector.

3. The deck pan assembly of claim 1 wherein the connecting structure formed by the two upturned edges includes a width at one portion of the connecting structure that is wider than a space that exists between the sides of the elongated stiffening connector, and wherein inserting the connecting structure between the sides of the elongated stiffening connector causes the sides to flex outwardly in order to receive the connecting structure.

4. The deck pan assembly of claim 1 wherein the connecting structure includes a self-locking portion that locks into the elongated stiffening connector.

5. The deck pan assembly of claim 4 wherein the self-locking portion of the connecting structure extends upwardly through a space between the sides of the elongated stiffening connector and projects into an open area that is formed in the upper portion of the elongated stiffening connector.

6. The deck pan assembly of claim 1 wherein the elongated stiffening connector includes a mouth that includes a flared opening and wherein the mouth is disposed in a lower portion of the elongated stiffening connector; and wherein the upturned edges of the two deck pans that form the connecting structure each include an upper end portion that is flared outwardly such that the upper portion of the connecting structure is wider than a lower portion of the stiffening connector.

7. The deck pan assembly of claim 1 further including a slab of concrete supported on the deck pans.

8. A deck pan assembly having multiple gauge metal components for receiving concrete and wherein the deck assembly and concrete form a composite deck for a building structure, the deck pan assembly comprising:

a. a series of metal deck pans having a length and wherein each of the deck pans includes a web and at least one flange extending at an angle with respect to the web;

b. at least one elongated stiffening connector that engages at least two flanges of at least two metal deck pans and at least forms a part of a connection that connects the two deck pans together;

c. wherein the stiffening connector is configured to connect the two deck pans together and wherein the stiffening connector is configured to receive the two flanges and forms a cap that extends over and around a portion of the two flanges;

d. wherein the stiffening connector extends substantially the entire length of the deck pans while connecting the deck pans together;

e. wherein at least one deck pan is formed from sheet metal of a first thickness and wherein the stiffening connector is formed of sheet metal of a second thickness that is greater than the first thickness; and f. one or more fasteners for connecting the stiffening connector to the flanges of the two pans and wherein the fasteners extend through the elongated stiffening connector and through the two flanges.

9. The deck pan assembly of claim 8 wherein the elongated stiffening connector includes a pair of side walls that are at least partially flexible and wherein the flanges are configured such that inserting the elongated stiffening connector over the flanges causes the side walls to flex outwardly.

10. The deck pan assembly of claim 8 wherein the stiffening connector is elongated and includes a web having a pair of opposed walls extending from the web and a diverging mouth formed about end portions of the walls opposite the web.

11. The deck pan assembly of claim 10 wherein the flanges of the two pans are disposed in side-by-side relationship and inserted into the diverging mouth of the elongated stiffening connector and wherein the flanges are configured to snap into place such that the opposed walls of the stiffening connector extend downwardly over the two upturned edges.

12. The deck pan assembly of claim 8 wherein the series of fasteners extend transversely through the flanges and transversely through portions of the elongated stiffening connector; and wherein the flanges of the two metal deck pans extend between portions of the elongated stiffening connector such that the flanges are sandwiched between portions of the elongated stiffening connector.

13. The deck pan assembly of claim 8 wherein the elongated stiffening connector includes an elongated trough which is configured to be inverted.

14. The deck pan assembly of claim 13 wherein the elongated trough formed by the stiffening connector is configured to be inverted and to at least partially encapsulate the flanges of the two deck pans.

15. The deck pan assembly of claim 8 wherein the stiffening connector includes an elongated cavity for receiving the flanges and wherein the stiffening connector is configured to receive the flanges and forms a cap that extends over and around a portion of the flanges.

* * * * *